US007222756B2

(12) United States Patent
Lo

(10) Patent No.: US 7,222,756 B2
(45) Date of Patent: May 29, 2007

(54) SELF-CONTAINED, PORTABLE AND AUTOMATIC FLUID DISPENSER

(75) Inventor: Raymond Lo, Wan Chai (HK)

(73) Assignee: Touch Free Applications LLC, Moorestown, NJ (US)

( * ) Notice: Subject to any disclaimer, the term of this patent is extended or adjusted under 35 U.S.C. 154(b) by 323 days.

(21) Appl. No.: 10/869,203

(22) Filed: Jun. 16, 2004

(65) Prior Publication Data

US 2005/0279783 A1 Dec. 22, 2005

(51) Int. Cl.
*B65D 88/54* (2006.01)

(52) U.S. Cl. ..... 222/333; 222/621

(58) Field of Classification Search ..... 222/333, 222/621, 628, 255, 257, 258, 262, 263, 320, 222/334, 321.7, 321.6, 321.9, 333.1; 239/332, 239/351, 381

See application file for complete search history.

(56) References Cited

U.S. PATENT DOCUMENTS 1,730,684 A * 10/1929 Phillips ..... 222/321.9
3,463,082 A * 8/1969 Helmut ..... 101/144
4,060,182 A * 11/1977 Kikuchi ..... 222/333
4,113,147 A * 9/1978 Frazier et al. ..... 222/131
5,014,884 A * 5/1991 Wunsch ..... 222/333
2004/0050875 A1* 3/2004 Kobayashi ..... 222/333

* cited by examiner

*Primary Examiner*—Lien M. Ngo
(74) *Attorney, Agent, or Firm*—Howard C. Miskin, Esq.; Gloria Tsui-Yip, Esq.

(57) ABSTRACT

A fluid dispenser includes a housing, a sleeve reservoir and a container. The housing has a nozzle for dispensing the fluid and contains a power source, an infrared sensor, an integrated circuit chip and a pump assembly. The pump assembly includes a motor, at least one gear, a pipe and a helical shaft positioned coaxially within the pipe. The helical shaft is driven rotatingly relative to the pipe. The sleeve reservoir has open upper and lower ends, overflow openings near the upper end and a ball valve at the lower end. The sleeve reservoir is first inserted into the container before fluid is poured into the container. The helical shaft and pipe are then inserted co-axially into the sleeve reservoir, submerging them in the fluid and flooding the space between the helical shaft and the pipe to minimize the time delay for dispensing the fluid.

37 Claims, 4 Drawing Sheets

SELF-CONTAINED, PORTABLE AND AUTOMATIC FLUID DISPENSER

FIELD OF THE INVENTION

The invention relates to a device for dispensing fluid. In particular, a self-contained, portable and automatic fluid dispenser that is capable of dispensing fluid of various viscosity.

BACKGROUND OF THE INVENTION

Dispensers of fluid or liquid are commonly used in industrial, business, residential and hospital settings. The most common type of fluid dispensers have plunger pumps with the soap container at the bottom wherein a user pushes a lever or handle downward to draw fluid upward for ejection at a nozzle near the top. Disadvantageously, this type of dispenser requires the user to push the lever or pump handle numerous time upon initial use to draw sufficient fluid upward for dispensing at the nozzle. When this type of dispenser has not been used for a period of time, fluid in the pump sometimes flows back to the soap container due to gravity and again requires numerous pumping before fluid is dispensed.

Since fluid dispensers are often used to dispense cleansing or disinfecting fluids such as soap and anti-microbial gel, it is preferable that the fluid dispensers dispense the fluid without the user contacting the dispensers. Some prior art dispensers have incorporated infrared sensors such that upon detection of a user's hand near the sensors, a predetermined amount of fluid is dispensed. Prior art automatic dispensers are usually wall-mounted or sink-mounted and are powered via electrical outlets. Disadvantageously, these type of mounted automatic dispensers are expensive and not portable. Further, a malfunctioned mounted automatic dispenser requires either a technician for on-site servicing or a technician for often complicated disassembling of the dispensers for off-site servicing.

U.S. patent application Publication No. 2004/0050875 discloses a liquid dispenser that is battery powered and portable. This dispenser also provides a sensor for automatic dispensing of liquid. This dispenser utilizes a rotating helical screw pump to draw fluids from a liquid container at the bottom upward for ejection at a nozzle near the top. Similar to the plunger pump dispensers, disadvantageously, liquid is dispensed with a time delay since it requires numerous rotation of the helical pump to draw sufficient fluid upwards for dispensing at the nozzle. Further, liquid in the helical screw pump is more prone to flow back to the liquid container than the plunger pump, thereby resulting in time delay in dispensing liquid each time the dispenser is used. Another disadvantage is that this prior art liquid dispenser cannot be used to dispense fluid with high viscosity, such as gel, because the rotation of the helical screw pump against the gel along the helical pump causes the viscosity characteristic to break down and liquefies the gel.

Therefore, there is a need for a fluid dispenser that automatically and promptly dispenses fluid of various viscosity, be self-contained and portable.

SUMMARY OF THE INVENTION

The present invention provides a fluid dispenser that automatically and promptly dispenses fluid of various viscosity and is self-contained and portable.

The fluid dispenser of the present invention is preferably battery operated and dispenses different viscosity fluid such as lotion, soap, gel sanitizer, mouthwash, etc. The fluid dispenser has a sensor, preferably infrared, that upon detecting the presence of a user's hand, the dispenser, controlled by an integrated circuit (IC) chip, automatically dispenses a predetermined amount of fluid.

The fluid dispenser comprises a housing, a sleeve reservoir and a container for storing fluid. The housing has a nozzle for dispensing the fluid and contains the power source, sensor, integrated circuit chip and pump assembly. The pump assembly comprises a motor and gears within the housing and a shaft combination that extends beyond the housing. The shaft combination comprises a pipe and a helical shaft positioned coaxially within the pipe. The motor, via gears, rotatingly drives the helical shaft relative to the pipe.

The sleeve reservoir is a cylindrical tube with open upper and lower ends. At the lower end of the sleeve reservoir is a ball valve. Near the upper end of the sleeve is a plurality of overflow openings.

The container has a cylindrical neck portion. The sleeve reservoir is first inserted through the neck portion into the container before fluid is poured into the container. Excess fluid overflows from the overflow openings of the sleeve into the container. With the housing resting on top of the container, the shaft combination of the pump assembly is inserted co-axially into the sleeve reservoir within the container, submerging the shaft combination in the fluid. The fluid floods the space between the helical shaft and the pipe of the shaft combination. As a result, upon initial rotation of the helical shaft, fluid is dispensed from the nozzle of the housing with minimal delay. When fluid is drawn upward by the helical shaft and is dispensed, the fluid in the sleeve reservoir is continuously replenished from the container through the ball valve, thereby maintaining a high level of fluid in the shaft combination.

In a preferred embodiment, a rotating dial is provided on the housing to control the speed of the motor and helical shaft by varying the resistance and voltage to the motor. By changing the motor and shaft rotation speed, a user can adjust the fluid dispenser for dispensing different viscosity fluid or such that different amount of fluid is dispensed.

BRIEF DESCRIPTION OF THE DRAWINGS

A preferred embodiment of the present invention has been chosen for purposes of illustration and description and is shown in the accompanying drawings forming a part of the specification wherein.

DETAILED DESCRIPTION OF THE PREFERRED EMBODIMENTS

Figure 1:
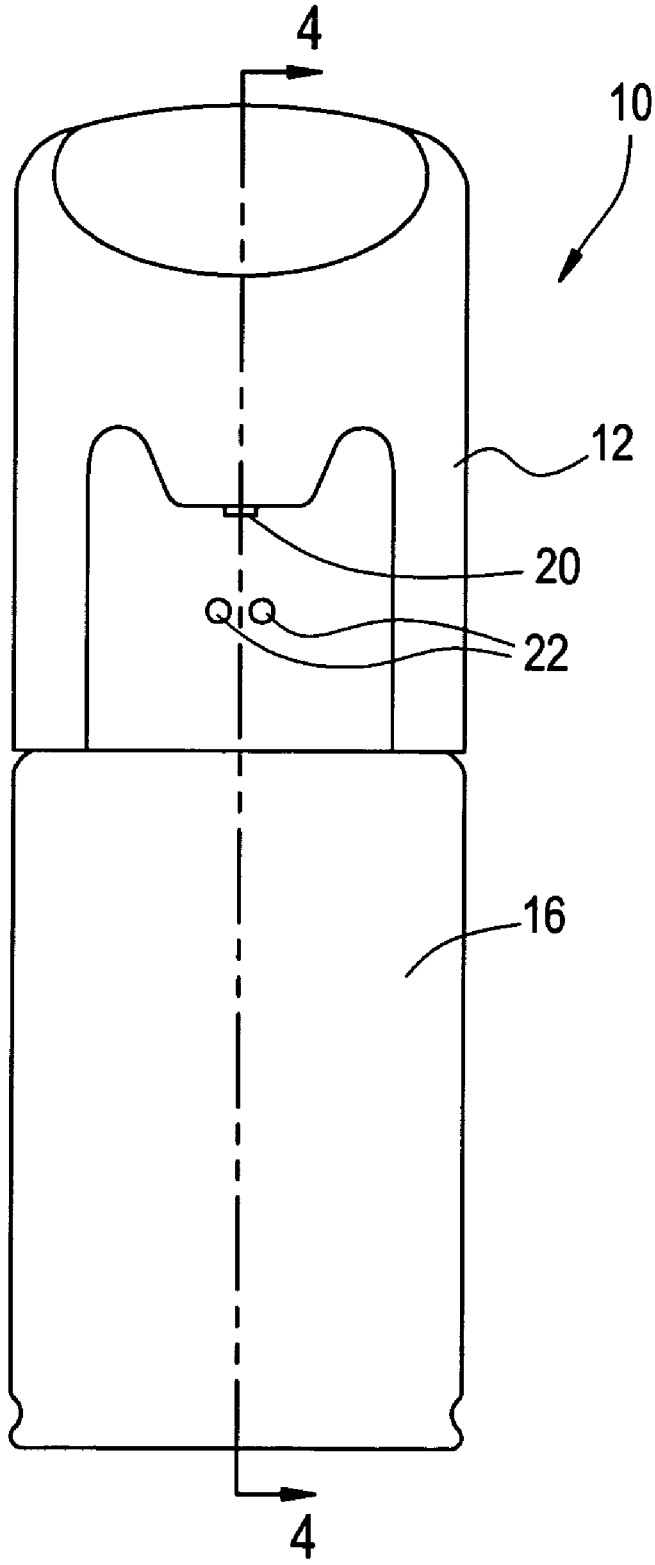
FIG. 1 is the front view of the fluid dispenser of the present invention.
Figure 2:
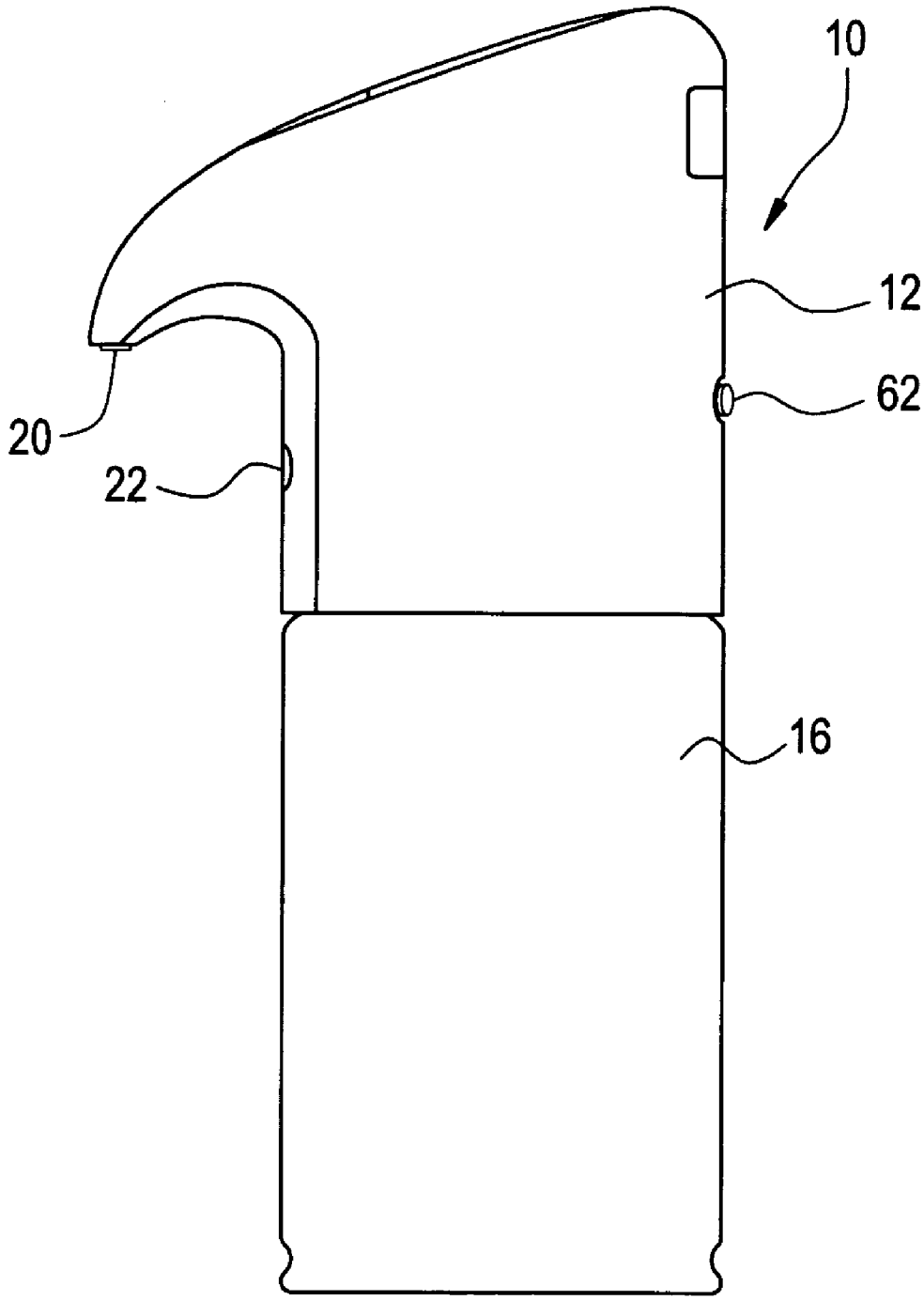
FIG. 2 is the side view thereof.
Figure 3:
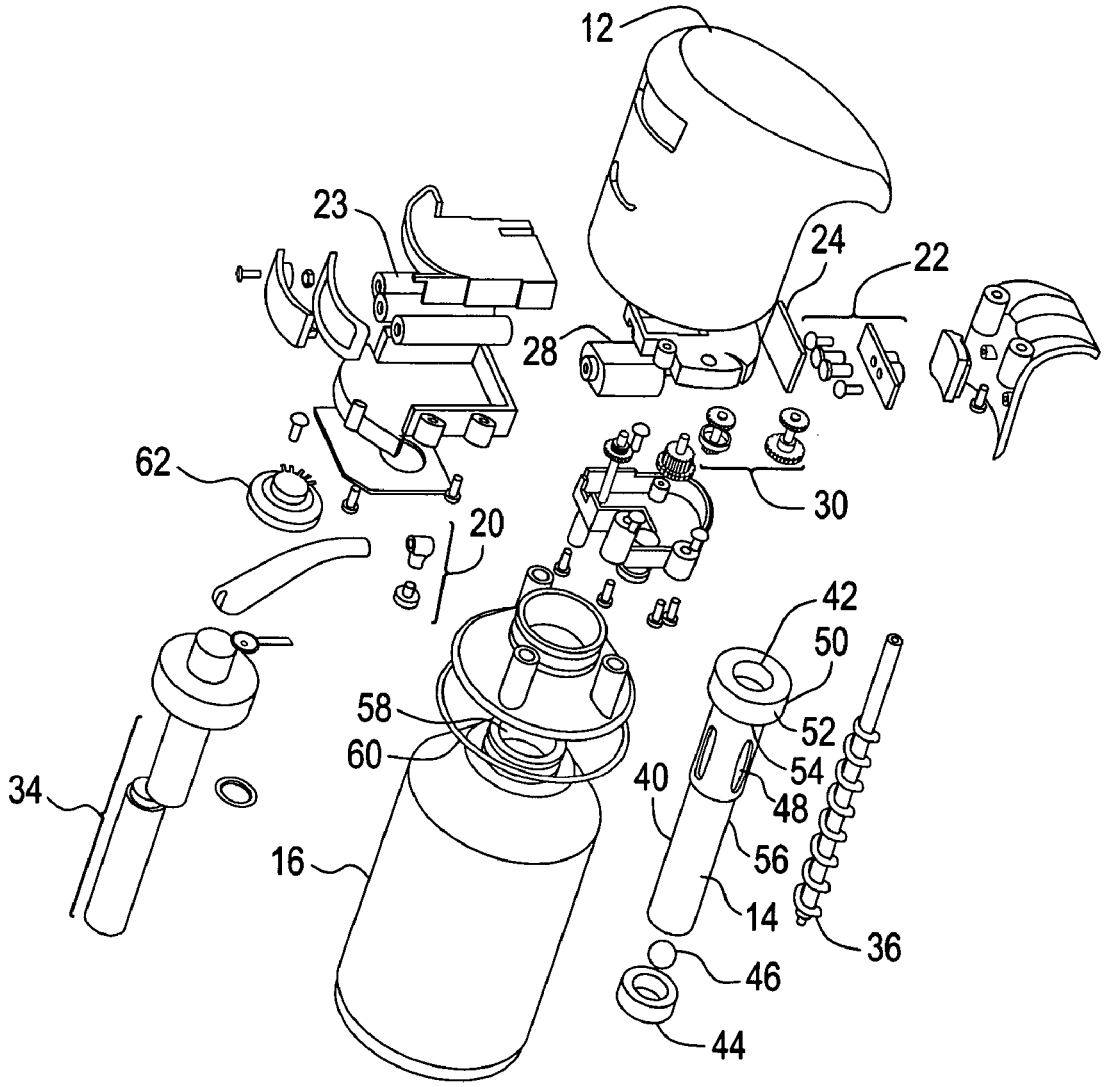
FIG. 3 is an exploded view of the components of the fluid dispenser.
Figure 4:
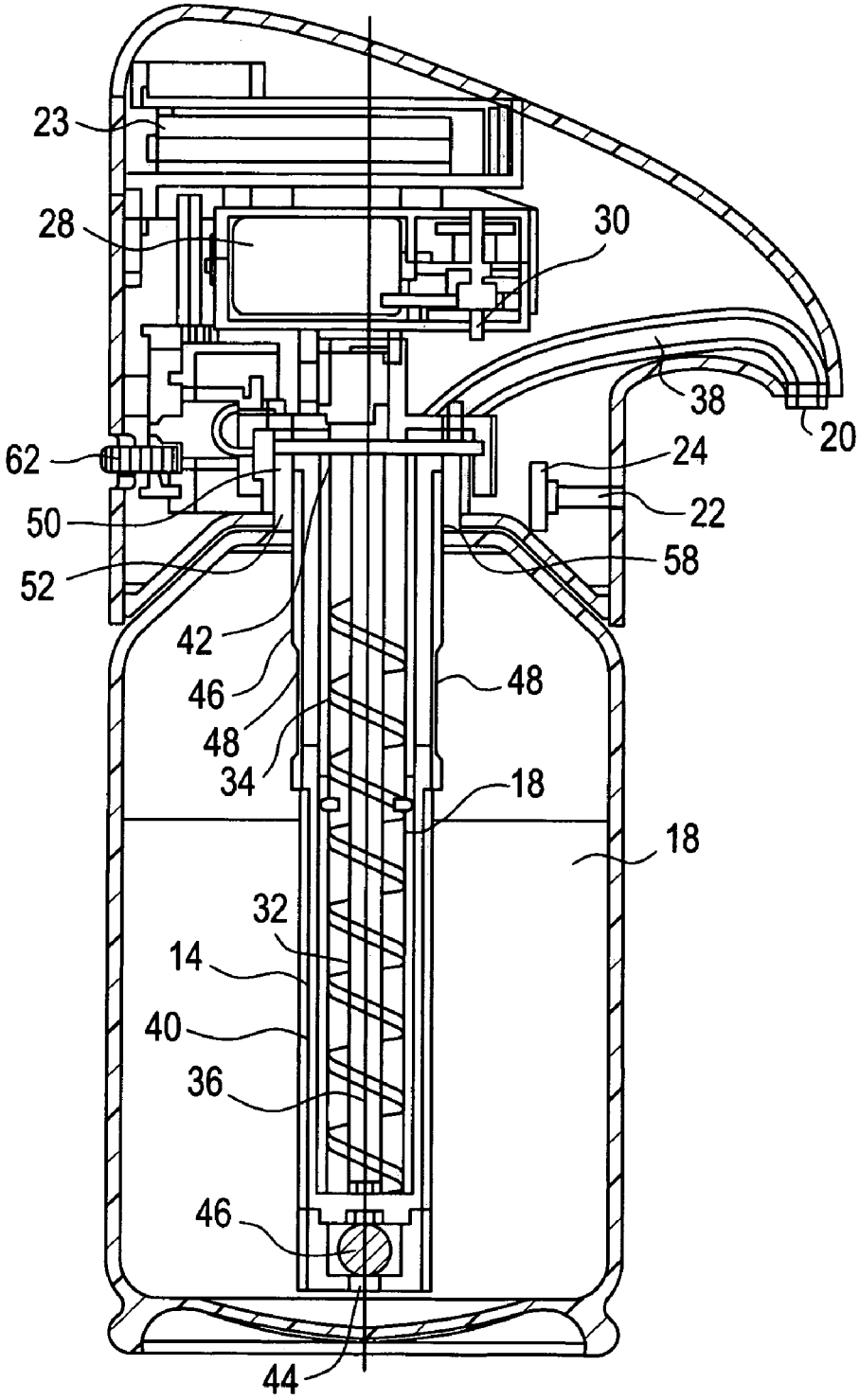
FIG. 4 is the cross-sectional view taken along line 4—4 in FIG. 1.

With reference to the drawings, wherein the same reference number indicates the same element throughout, there is shown in FIGS. 1–3 a fluid dispenser 10 of the present invention. Fluid dispenser comprises a housing 12, a sleeve reservoir 14 and a container 16 for storing fluid 18. Housing 12 sits on top of and correspondingly mates with container 16.

Housing 12 has a nozzle 20 for dispensing fluid 18 from the container 16. Nozzle is preferably extended slightly beyond the housing 12 to prevent droplets of fluid 18 from forming at the nozzle 20. The housing 12 has a sensor 22 that detects the presence of a user's hand or an object to dispense fluid 18 from the container 16. Sensor 22 is preferably an infrared sensor, which is known to one skilled in the art of electronics. Housing 12 contains the power source 23 and an integrated circuit (IC) chip 24 and a pump assembly 26. Power source 23 is shown as a plurality of batteries. However, the fluid dispenser 10 may be adapted, as known to one skilled in the art of electronics, to be powered by alternating current from an outlet. The IC chip 24 provides a signal to the power source 23 to release current to the pump assembly 26 for dispensing fluid 18 upon receiving a signal from sensor 22. Electrical connection among the power source 23, sensor 22, IC chip 24 and pump assembly 26 are not shown to simplify the drawings since it is known to one skilled in the art of electronics how this is accomplished. IC chip 24 signals to the pump assembly 26 how long to stay on after the sensor 22 is actuated to dispense a predetermined amount of fluid 18. The length of time for the operation of the pump assembly 26 to remain on can also depend on the selected viscosity of the fluid 18 being dispensed.

The pump assembly 26 comprises a motor 28 and gears 30 within the housing 12 and a shaft combination 32 that extends beyond the lower portion of housing 12. The shaft combination 32 comprises a pipe 34 and a helical shaft 36 coaxially within the pipe 34. The widest diameter extent of the helical shaft 36 is slightly smaller than the internal diameter of pipe 34. The motor 28, via the gears 30, rotatingly drives the helical shaft 36 relative to the pipe 34 to draw fluid 18 upward from the container 16, through the pipe 34 to a conducting pipe 38 and out of the nozzle 20. The IC chip 24 controls the length of time of the pump assembly 26 remains operating by controlling the number of turns of the helical shaft 36 to control the amount of fluid 18 being dispensed. Conducting pipe 38 has a length and sharp angle near the nozzle 20 to control the momentum of the fluid 18 and avoid dripping of excessive fluid 18 after each actuation of the pump assembly 26.

The sleeve reservoir 14 is a generally cylindrical tube 40 with open upper and lower ends 42 and 44, respectively. The diameter of the cylindrical tube 40 is slightly larger than the pipe 34 to form an annular gap. At the lower end 44 of the tube 40 is a ball valve 46. Preferably, the ball valve 46 comprises a precise ball used for ball bearings. Near the upper end 42 of the tube 40 is a plurality of overflow openings 48. The upper end 42 of the tube 40 has an enlarged portion 50 with a fold-over annular lip 52 defining a circular groove 54 between the lip 52 and the outer circumferential wall 56 of the tube 40. The internal wall of the lip 52 has reverse threading. The outer wall of the annular lip 52 has threading that correspondingly receives threading in the lower portion of housing 12 near the proximal end of the shaft combination 32.

The container 16 has an opening 58 at a cylindrical neck portion 60. The outer wall of the neck portion 60 has reverse threading that correspondingly receives the reverse threading on the internal wall of the annular lip 52 of the sleeve reservoir 14.

To assemble the fluid dispenser 10 for use, the sleeve reservoir 14 is first inserted into the opening 58 of the container 16, with the reverse threading on the sleeve reservoir 14 correspondingly engaging the reverse threading on the container 16. Upon full insertion of the sleeve reservoir 14 into container 16, the lower end 44 of the sleeve reservoir 14 is a short distance away from the bottom of the container 16. Fluid 18 is then poured into the container 16. Fluid 18 first fill the cavity of tube 40 of the sleeve reservoir 14, then with the excess fluid 18 overflowing from the overflow openings 48 into the container 16. Shaft combination 32 is then inserted co-axially into the sleeve reservoir 14, submerging the shaft combination 32 in the fluid 18 within the sleeve reservoir 14. Fluid 18 floods the space between the pipe 34 and helical shaft 36. Threading at the lower portion of housing 12 near the proximal end of the shaft combination 32 matingly engages the threading on the outer wall of the annular lip 52 of the sleeve. Upon engaging the housing 12 to the sleeve reservoir 14, and thereby, the container 16, the distal end of the shaft combination 32 is a short distance away from the ball valve 46 of the sleeve reservoir 14.

The fluid dispenser 10 of the present invention advantageously dispenses fluid 18 with minimal delay because fluid 18 is already present in the shaft combination 32 and upon actuation of the motor 28 and gears 30 via sensor 22, fluid 18 is readily dispensable at the nozzle 20. Further, due to the presence of fluid 18 in the shaft combination 32 at all time, high viscosity fluid such as gel can be dispensed without losing the high viscose characteristic because of the minimal interaction of the helical shaft 36 against the gel. When fluid 18 is drawn upward by the shaft combination 32 and is dispensed from the nozzle 20, the suction of the fluid 18 from sleeve reservoir 14 lifts the ball valve 46 from the lower end 44 to allow fluid 18 from the container 16 to replenish the fluid 18 in the sleeve reservoir 14. When the fluid dispenser 10 ceases dispensing fluid 18, the weight of the fluid 18 within the sleeve reservoir 14 and gravity pulls the ball valve 46 down the lower end 44 and prevents fluid 18 in the sleeve reservoir 14 to flow freely back into the container 16, thereby maintaining a high level of fluid 18 within the sleeve reservoir 14 and the shaft combination 32.

In an alternate embodiment, a rotating dial 62 is provided on the housing 12 to allow a user to control the speed and rotation of the motor 28 and helical shaft 36 by varying the resistance and voltage applied to the motor 28, which is known to one skill in the art of electronics. By varying the rotation speed of the motor 28 and helical shaft 36, a user can adjust the amount of fluid 18 being dispensed and can adapt the fluid dispenser 10 for different viscosity fluid 18.

The features of the invention illustrated and described herein is the preferred embodiment. Therefore, it is understood that the appended claims are intended to cover the variations disclosed and unforeseeable embodiments with insubstantial differences that are within the spirit of the claims.

I claim:

1. A device for dispensing fluid comprising:

a container for storing the fluid, a housing positioned adjacent said container and having a nozzle for dispensing the fluid, a pump assembly in said housing for drawing the fluid from said container to said nozzle, said pump assembly comprising a motor, at least one gear and a shaft combination driven by said motor via said at least one gear; and means for flooding and maintaining said pump assembly with the fluid such that upon actuation of said pump assembly, fluid is readily dispensed at said nozzle with minimal delay.

2. The device of claim 1 further comprising means for varying the speed of said motor and said shaft combination to dispense different viscosity fluid or different amount of fluid.

3. The device of claim 2 wherein said varying means comprising a rotating dial on said housing that varies the resistance and voltage applied to said motor.

4. The device of claim 1 wherein said motor and said at least one gear is within said housing and said shaft combination extends beyond said housing.

5. The device of claim 1 further comprising a power source for said motor.

6. The device of claim 5 wherein said power source comprises at least one battery.

7. The device of claim 1 wherein said shaft combination comprising a pipe and a helical shaft positioned coaxially within said pipe, and said helical shaft is rotatingly driven relative to said pipe by said motor via said at least one gear.

8. The device of claim 7 wherein the widest diameter extent of said helical shaft is slightly less than the diameter of said pipe.

9. The device of claim 1 wherein said flooding and maintaining means is a sleeve reservoir.

10. The device of claim 9 wherein said sleeve reservoir comprises a cylindrical tube having open upper and lower ends, at least one overflow opening near the upper end, and a ball valve at the lower end.

11. The device of claim 10 wherein said upper end of said cylindrical tube having an enlarged portion with a fold-over annular lip having an internal wall with reverse threading and an outer wall with threading, said cylindrical tube having an outer circumferential wall and a circular groove defined between said lip and said outer circumferential wall of said cylindrical tube.

12. The device of claim 11 wherein said housing having a lower portion and having a corresponding threading at said lower portion adjacent said pump assembly for engaging said threading on said outer wall of said lip of said sleeve reservoir.

13. The device of claim 10 wherein said shaft combination comprising a pipe and a helical shaft positioned coaxially within said pipe, and said helical shaft is rotatingly driven relative to said pipe by said motor via said at least one gear and the diameter of said cylindrical tube is slightly larger than the diameter of said pipe.

14. The device of claim 11 wherein said container having a cylindrical neck portion and an opening at said cylindrical neck portion for receiving said pump assembly.

15. The device of claim 14 wherein said neck portion having an outer wall with corresponding reverse threading for engaging said reverse threading on said internal wall of said lip of said sleeve reservoir.

16. The device of claim 1 further comprises means for actuating said pump assembly for dispensing the fluid.

17. The device of claim 16 wherein said actuating means comprises an infrared sensor that detects the presence of a user's hand or an object near said nozzle to dispense the fluid.

18. The device of claim 16 wherein said actuating means is within said housing.

19. The device of claim 16 further comprises an integrated circuit chip for receiving a signal from said actuating means and for sending a signal to actuate said pump assembly.

20. The device of claim 19 wherein said integrated circuit chip controls the length of time said pump assembly is actuated.

21. The device of claim 1 further comprises a conducting pipe connecting said pump assembly to said nozzle.

22. The device of claim 21 wherein said conducting pipe having a length and a sharp angle to control the momentum of the fluid and avoid dripping of excessive fluid after each actuation of said pump assembly.

23. The device of claim 1 wherein said nozzle extends beyond said housing to prevent droplets of fluid from forming at said nozzle.

24. A method of dispensing fluid, comprising the steps of:

a. providing a container having an opening for storing the fluid, b. providing a housing adjacent said container with a nozzle for dispensing the fluid, c. providing a pump assembly in said housing for drawing the fluid from said opening of said container to said nozzle, and d. providing means for flooding and maintaining said pump assembly with the fluid such that upon actuation of said pump assembly, fluid is readily dispensed at said nozzle with minimal delay, wherein said flooding and maintaining means is first inserted into said opening of said container before fluid is poured into said container through said opening and flooding and maintaining means, and a portion of said pump assembly is then inserted into said flooding and maintaining means and submerged in the fluid.

25. The method of claim 24 wherein said pump assembly comprising a motor, at least one gear within said housing and a shaft combination extending beyond said housing driven by said motor via said at least one gear, wherein said shaft combination is inserted into said flooding and maintaining means and submerged in the fluid.

26. The method of claim 25 wherein said shaft combination comprising a pipe and a helical shaft positioned coaxially within said pipe, and said helical shaft is rotatingly driven relative to said pipe by said motor via said at least one gear.

27. The method of claim 26 wherein said flooding and maintaining means is a sleeve reservoir comprises a cylindrical tube having open upper and lower ends, at least one overflow opening near the upper end, and a ball valve at the lower end.

28. The method of claim 27 wherein upon insertion of said sleeve reservoir into said container, said lower end of said sleeve reservoir is a short distance away from the bottom of said container.

29. The method of claim 28 wherein upon insertion of said shaft combination into said sleeve reservoir, the distal end of said shaft combination is a short distance away from said ball valve at said lower end of said sleeve reservoir.

30. The method of claim 27 wherein excess fluid poured into said sleeve reservoir overflows from said at least one overflow opening into said container.

31. The method of claim 29 wherein upon drawing fluid from said container to said nozzle, fluid in said sleeve reservoir is replenished from fluid in said container through said ball valve.

32. The method of claim 31 wherein upon cessation of drawing fluid from said container, said ball valve prevents fluid in said sleeve reservoir from flowing back into said container.

33. The method of claim 24 further comprising the steps of providing means for actuating said pump assembly for dispensing the fluid.

34. The method of claim 33 wherein said actuating means comprises an infrared sensor that detects the presence of a user's hand or an object near said nozzle to dispense the fluid.

35. The method of claim 33 further comprises the steps of providing an integrated circuit chip for receiving a signal from said actuating means and for sending a signal to actuate said pump assembly.

36. The method of claim 35 wherein said integrated circuit chip controls the length of time said pump assembly is actuated.

37. The method of claim 24 further comprises the steps of providing a conducting pipe connecting said pump assembly to said nozzle.

* * * * *